US006148643A

United States Patent [19]

Matsuda et al.

[11] Patent Number: 6,148,643

[45] Date of Patent: Nov. 21, 2000

[54] KNITTED-IN SLIDE FASTENER

[76] Inventors: Yoshio Matsuda, 1898, Uwano, Nyuzen-machi, Shimoniikawa-gun, Toyama-ken; Hidenobu Kato, 4020, Mikkaichi, Kurobe-shi, Toyama-ken; Yoshito Ikeguchi, 467-5, Taieno, Kurobe-shi, Toyama-ken, all of Japan

[21] Appl. No.: 09/547,092

[22] Filed: Apr. 11, 2000

[30] Foreign Application Priority Data

Apr. 30, 1999 [JP] Japan ..... 11-123891

[51] Int. Cl.[7] ..... D04B 23/14

[52] U.S. Cl. ..... 66/193; 66/195

[58] Field of Search ..... 66/83, 84 R, 85 R, 66/203, 84 A, 169 R, 170, 190, 192, 193, 195; 24/391, 392, 393

[56] References Cited

U.S. PATENT DOCUMENTS

| | | | |
|---|---|---|---|
| 5,540,064 | 7/1996 | Matsuda et al. | 66/193 |
| 5,615,563 | 4/1997 | Matsuda et al. | 66/195 |
| 5,685,177 | 11/1997 | Matsuda et al. | 66/193 |
| 5,794,460 | 8/1998 | Matsuda et al. | 66/195 |
| 5,857,359 | 1/1999 | Matsuda et al. | 66/193 |

FOREIGN PATENT DOCUMENTS

| | | | |
|---|---|---|---|
| 2179222 | 11/1973 | France | 66/193 |

*Primary Examiner*—Danny Worrell

[57] ABSTRACT

The present invention intends to provide a knitted-in slide fastener having a flexibility and capable of securing a desired coupling strength, in which a trace of the fastener element row is unlikely to be made by ironing. A basic structure of knitting of a fastener element attaching portion formed along a side edge of a fastener tape is formed of chain knitting yarns and weft in-laid yarns. A fastener element row is disposed on an upper face of sinker loops of binding chain knitting yarns, attaching portion foundation chain knitting yarns and the weft in-laid yarns and a leg portion of each element portion is tightened and bound by needle loops of the binding chain knitting yarns from an upper face thereof. The weft in-laid yarns inserted such that they are inverted alternately between two rows of wales disposed in the element attaching portion beside the tape main portion have a size larger than other weft yarns. The weft in-laid yarns inserted such that they are inverted alternately between the wale disposed in the element attaching portion nearest to the tape main portion and wales formed by any one of the binding chain knitting yarns have heat shrinkage characteristic. By heating the yarns, a substantially half portion of the fastener element row is sunk below the surface of the fastener tape main portion.

4 Claims, 2 Drawing Sheets

KNITTED-IN SLIDE FASTENER

BACKGROUND OF THE INVENTION

1. Field of the Invention

The present invention relates to an improvement of a knitted-in slide fastener in which a continuous fastener element row of synthetic resin is bound by knitting into a side edge of a fastener tape at the same time when the warp knitted fastener tape is formed by knitting.

2. Description of the Related Art

This kind of the knitted-in slide fastener, which has been practically used, has been disclosed in Japanese Patent Application Laid-Open No. 10-42915 with a production method thereof. The knitted-in slide fastener,as exemplified in the publication, has an attaching portion of a fastener element row along a side edge in the longitudinal direction of the fastener tape. The attaching portion is comprised of chain knitting yarns of four wales, warp in-laid yarns knitted such that they are inverted alternately into chain knitting yarn stitches of the three outermost wales, weft in-laid yarns inserted in a zigzag shape successively over three wales of each wale of all courses and weft in-laid yarns inserted in a zigzag shape over respective two wales of the two wales inside and two wales outside of the tape. This specification describes that when the knitting density of a knitted slide fastener stringer is rough, heat shrinkage fiber such as modified polyester resin may be used as all the weft in-laid yarns.

At the same time when the fastener tape is knitted with the aforementioned knitting structure, synthetic resin monofilament is inserted in the weft-direction into the fastener element attaching portion so that a continuous coil-shaped fastener element row is molded and simultaneously knitted therein to bind and produce a fastener stringer. In the aforementioned fastener stringer, a leg portion of each of the fastener element portions arranged in parallel is tightened and bound by needle loops of the chain knitting yarns from above and all the other structures are disposed on a bottom face of the fastener element row.

Not only in a conventional knitted-in slide fastener of this kind, but also in a slide fastener in which the continuous fastener element row is fixed to the fastener tape by sewing as well as the aforementioned knitted-in slide fastener disclosed in the above publication, the fastener element row is placed and fixed on the surface of the fastener tape. Thus, a height of the surface of the tape is substantially equal to a thickness of the two leg portions stacked vertically.

Recently, a thin clothes material excellent in soft feeling, for example, knitted fabric, has been often used in clothes field. The aforementioned knitted-in slide fastener or a woven-in slide fastener composed of thin and flexible material and structure has been used in these clothes.

As described above, the fastener tape itself should be flexible and the fastener element row to be attached thereto should also be flexible since it is synthetic resin monofilament molded in a coil shape or zigzag shape. However, attachment of the aforementioned flexible fastener element row onto the aforementioned flexible fastener tape is carried out basically in the same way as attachment of the fastener element row to other general fastener tapes. In other words, since in the knitted-in or woven-in slide fastener, the leg portion of each element portion of the fastener element row is tightened and bound with plural binding yarns, a portion to which the fastener element row of the slide fastener is attached is stiffened, so that the slide fastener itself which must be flexible is made into a bar-like condition. Consequently, when such a slide fastener is attached to clothes by sewing or the like, there arises a great feeling of discomfort. This is the same when the fastener element row is fixed to the fastener tape by sewing.

Thus, it can be considered to employ flexible material for the fastener stringer itself, namely the fastener tape itself and the structuring material itself of the fastener element row itself or use fewer binding yarns to attach the fastener element row onto the fastener tape and at the same time, weaken the tightening force. However, in this case, the fastener element row is likely to be deformed or moved easily. As a result, the coupling strength of the fastener elements decreases so that a slip-out of the coupling is likely to occur and therefore, the function as a slide fastener is lost.

Further, when a fastener element row of a conventional slide fastener is attached, as described above, the fastener element row is placed on the surface of the fastener tape and fixed thereto. The height of protrusion above the surface of the tape is substantially the same as a thickness of two leg portions stacked vertically. Thus, when thin clothes employing this slide fastener is ironed, a trace of the fastener element row is clearly left on the fabric.

SUMMARY OF THE INVENTION

Accordingly, the present invention has been achieved to solve the conventional problem, and specifically, an object of the invention is to provide a knitted-in slide fastener having a flexibility and capable of securing a desired coupling strength, in which a trace of the fastener element row is unlikely to be made by ironing.

As a result of considerations to achieve the above object, the inventors of the present invention have come to know that it is favorable to employ a warp knitting structure to secure flexibility of the fastener tape itself and stability of the configuration and further, it is most favorable to follow the structural and knit-binding principle described in above-mentioned publication for knitting structure of the fastener tape and the knit-binding of the fastener element row into the tape.

Therefore, according to the present invention, the knitting structure and binding method of fastener element row described in the aforementioned publication are employed as a basic feature, and further, it is an attempt for achieving improvement in above-mentioned object. However, the knitting structure of the present invention is not restricted to the structure exemplified in the publication, and it will be evident by a description below that the present invention may be modified into various ways without changing a scope of the principles.

The above object is effectively achieved as follows.

Preferably, there is provided a knitted-in slide fastener, in which a continuous fastener element row is knitted into a fastener element attaching portion formed continuously along a side edge of a fastener tape main portion composed of warp knitted foundation structure simultaneously with knitting the fastener tape, wherein the fastener element attaching portion is comprised of plural rows of wales of binding chain knitting yarns for tightening and binding a leg portion of each element portion, plural rows of wales of attaching portion foundation chain knitting yarns forming a foundation structure of the attaching portion, and plural weft in-laid yarns inserted such that they are inverted alternately between the wales. The continuous fastener element row is disposed on an upper face of sinker loops of the binding chain knitting yarns, the attaching portion foundation chain knitting yarns, and the weft in-laid yarns, while the leg portion of each element portion is tightened and bound from an upper face by needle loops of the binding chain knitting yarns. The weft in-laid yarns caught such that they are inverted alternately between each wale formed of the attaching portion foundation chain knitting yarns beside the fastener tape main portion and the binding chain knitting yarns beside the leg portion of the element portion are formed of a yarn having a larger size than other knitting yarns, the weft in-laid yarn disposed on the upper face of the weft in-laid yarn having a large size intersecting therewith and caught such that they are inverted alternately between wales formed of the attaching portion foundation chain knitting yarn beside said fastener tape main portion and any one of the binding chain knitting yarns is formed of a yarn having heat-shrinkage characteristic, and the weft in-laid yarn having a large size is disposed on a bottommost face of the fastener tape.

Further preferably, the knitting structure of the fastener element attaching portion of the fastener tape is formed of the attaching portion foundation chain knitting yarns, sinker loops of the binding chain knitting yarns and weft in-laid yarns, and on the other hand, only the needle loops of the binding chain knitting yarns are used to knit and bind the fastener element portion. Thus, the configurations in the longitudinal direction and width direction of the tape are stabilized by the chain knitting yarns and weft in-laid yarns and further, the element attaching portion of the fastener tape is not thickened and the attaching portion itself is highly flexible.

Since the upper/lower leg portions of the fastener element portions arranged in parallel are bound with needle loops of the binding chain knitting yarns to knit and bind the fastener element row, the fastener element row is fixed securely. Further, a pitch between the respective fastener element portions is not changed and respective coupling heads are not deviated in the width direction of the tape. Consequently, a desired coupling strength is secured and no slip-out of the coupling is generated.

Further, according to the present invention, the weft in-laid yarns caught such that they are inverted alternately between respective wales formed of the attaching portion foundation chain knitting yarns disposed beside the fastener tape main portion and binding chain knitting yarns disposed beside the connecting portion of the element portion are composed of yarns having a larger size than other knitting yarns. The weft in-laid yarns disposed on the upper face of the weft in-laid yarn having a large size intersecting therewith and caught such that they are inverted alternately between wales formed of the attaching portion foundation chain knitting yarn beside the fastener tape main portion and any one of the binding chain knitting yarns are formed of yarns having heat shrinkage characteristic. The weft in-laid yarn having a large size is disposed on a bottommost face of the fastener tape.

As a result, when the weft in-laid yarns composed of the yarns having heat shrinkage characteristic are shrunk by heat treatment of the fastener chain after the fastener chain is manufactured, the interval between the wales in which the weft in-laid yarns are caught is tightened by a shrinkage of the weft in-laid yarns. At the same time, the weft in-laid yarns having a large size are swollen to the rear face side of the tape so that a step is generated in a border portion between the tape main portion and element attaching portion. Consequently, a substantially half portion in the height direction of the continuous fastener element row sinks below the surface of the fastener tape main portion.

With such a structure, when the knitted-in slide fastener formed of the aforementioned fastener tape is attached on, for example, thin clothes, there is no special feeling of discomfort with respect to the clothes, and no trace of the fastener element portions is left on the fabric even when the clothes is ironed. A beautiful finish can always be expected.

In the present invention, the knitting structure and quality of yarns such as thickness, material and the like of the fastener tape main portion are not restricted to any particular type, and they may be general knitting structures and quality of yarns which are employed in the conventional knitted-in slide fasteners.

Still preferably, a connecting portion for connecting adjacent leg portions of the element portion is disposed in the center between the wales formed of the attaching portion foundation chain knitting yarn beside the fastener tape main portion and the binding chain knitting yarn beside the leg portion of the element portion. By adding the feature of the previously mentioned description, the connecting portion for connecting the leg portions of the element portions is disposed between a wale formed of the attaching portion foundation chain knitting yarns beside the fastener tape main portion and a wale formed of the binding chain knitting yarns beside the leg portion of the element portion. As a result, the tape main portion is deformed such that it is turned upward with an interval between the two wales as its center. Consequently, the aforementioned step portion formed of the weft in-laid yarns having a large size, swollen to the rear side of the tape due to a shrinkage of the weft in-laid yarns composed of heat shrinkage yarns appears more obviously.

It is preferable that there is provided a knitted-in slide fastener, wherein the foundation chain knitting yarn disposed at an outermost side of the fastener element attaching portion is formed of a yarn having a smaller size than the binding chain knitting yarn. By adding the feature of the aforementioned description, the outer side edge of the fastener element attaching portion is the thinnest portion, so that when the fastener element rows are coupled by sliding the slider, the outer side edge is not bitten by upper and lower wing plates of the slider and then, the slider is guided smoothly in the narrow sliding space.

It is further preferable that, warp in-laid yarns are disposed below the fastener element row and caught such that they are inverted alternately between each chain knitting yarn stitches along the wale formed of the binding chain knitting yarns and the wale of the attaching portion foundation chain knitting yarns disposed at an outermost side of the fastener element attaching portion. With such a structure, the configuration of the wales formed of the binding chain knitting yarns and attaching portion foundation chain knitting yarns is stabilized so that the fastener element row can be bound to the fastener element attaching portion in a further stabilized state.

DESCRIPTION OF THE PREFERRED EMBODIMENTS

Figure 1:
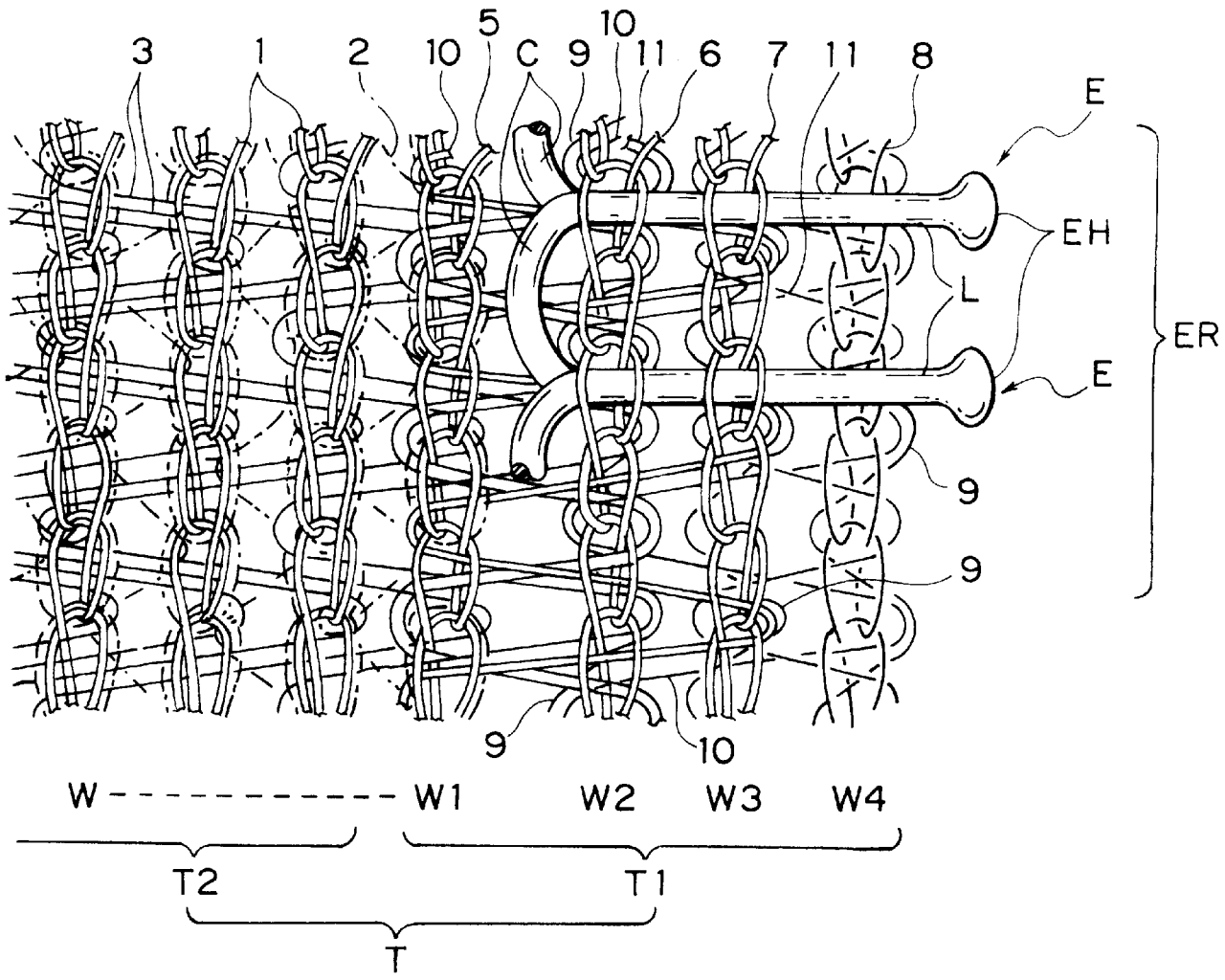
FIG. 1 is a knitting structure diagram of a principal portion of a slide fastener according to a typical embodiment of the present invention as viewed from above.
Figure 2:
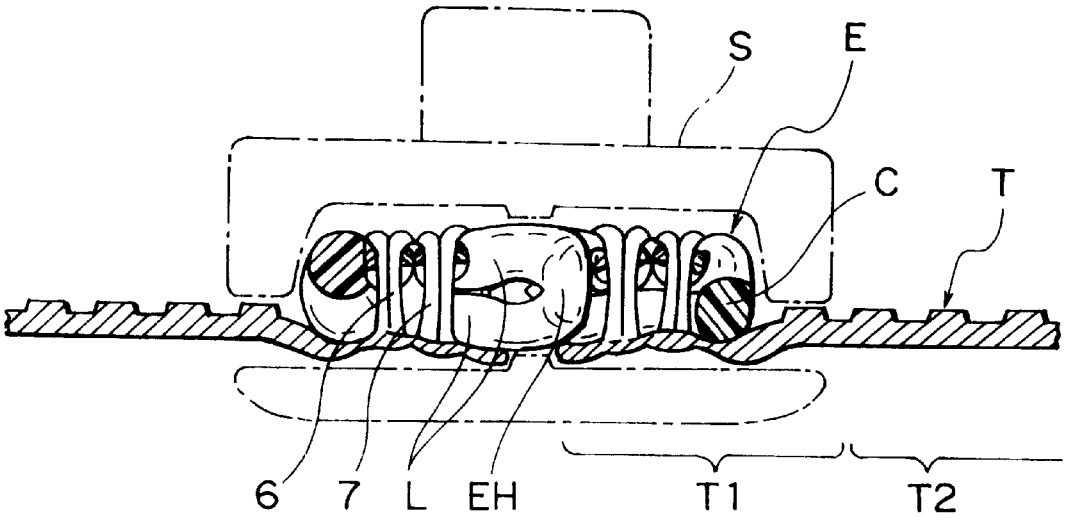
FIG. 2 is a sectional view of the principal portion showing a coupling state of the slide fastener.

Hereinafter, typical embodiments of the present invention will be described in detail with reference to the accompanying drawings. FIG. 1 is a diagram of the structure of a principal portion as viewed from above by cutting out a part of the knitted-in slide fastener according to an embodiment of the present invention. FIG. 2 is a sectional view of a principal portion showing schematically a coupling state of an element row of the slide fastener.

As understood from FIG. 1, the knitted-in slide fastener according to this embodiment has a fastener element attaching portion T1 along a side edge in the longitudinal direction of the fastener tape T. A tape main portion T2 of the fastener tape T excluding the fastener element attaching portion T1 is knitted of chain knitting yarns 1 (1-0/0-1), tricot knitting yarns 2 (1-2/1-0) and weft in-laid yarns 3 (0-0/4-4) inserted over four wales W in a zigzag shape successively in the course direction of the wales.

The knitting structure of the tape main portion T2 is not restricted to an example shown in the figure, but a knitting structure employed for ordinary fastener tape may be used and further, quality of yarn and knitting density may be determined arbitrarily.

The knitting structure of the aforementioned fastener element attaching portion T1 is comprised of chain knitting yarns 5–8 (1-0/0-1) composing four wales W1–W4, warp in-laid yarns 9 (0-0/1-1) knitted such that they are inverted alternately to catch in a zigzag shape between chain knitting yarn stitches along the three outer wales of the four wales, i.e. W2–W4, a first weft in-laid yarn 10 (0-0/3-3) inserted in a zigzag shape successively over three wales of four wales W1–W4, and a second weft in-laid yarn 11 (0-0/2-2) knitted such that they are inverted alternately to catch in a zigzag shape between two wales W1, W2 of the tape main body T2 side and between two wales W3, W4 of an outer side of the fastener element attaching portion T1.

According to this embodiment, among the chain knitting yarns 5–8 (1-0/0-1) composing the aforementioned four wales W1–W4, two wales W2, W3 in the center are composed of binding chain knitting yarns 6, 7 of the fastener element row of the present invention and two wales W1, W4 disposed on both sides thereof are composed of foundation chain yarns 5, 8 of the present invention. Part of the aforementioned first weft in-laid yarns 10 (0-0/3-3) are inserted in the weft-direction in a zigzag shape over three wales including the fastener element attaching portion T1 and a wale adjacent to the attaching portion T1 of the tape main portion T2.

In the fastener element row ER to be knitted into the fastener element attaching portion T1 according to this embodiment, as understood from FIG. 1, respective element portions are knitted once in every two courses. More specifically, just after the foundation structure of the fastener element attaching portion T1 is knitted by a course, a weft yarn is inserted over a synthetic resin monofilament molded in a coil shape preliminarily or molded into a coil shape at the time of knitting. Sinker loops of the aforementioned binding chain knitting yarns 6, 7, foundation chain knitting yarns 5, 8, warp in-laid yarn 9, first weft in-laid yarn 10 and second weft in-laid yarn 11 are disposed at a bottom face of the molded element portion E and then, needle loops of the aforementioned binding chain knitting yarns 6, 7 are disposed so as to tighten a top face of the element portion E. By repeating these procedures, the fastener element row ER is knitted into the fastener tape T.

The aforementioned element portion E, as understood from FIGS. 1 and 2, connects a protruding end of an upper/lower leg portion L protruding perpendicularly and horizontally from the side edge of the fastener element attaching portion T1 of the fastener tape T in a perpendicular direction with respect to a face of the tape, and is provided with a coupling head EH having a swollen portion which is swollen substantially in parallel to the aforementioned side edge. The upper/lower leg portions adjacent in the longitudinal direction of the tape are connected by a connecting portion C between the upper/lower leg portions.

Since a basic structure of the fastener element attaching portion T1 of the fastener tape T according to this embodiment is formed simply by connecting the chain knitting yarn with the weft in-laid yarn as described above, it has flexibility although its shape is stabilized. Further, since the element portion E is bound with a total of four yarns of the needle loops of the binding chain knitting yarns 6, 7, the element portion E never moves on the tape. Thus, a pitch between respective element portions E is made constant so that a desired coupling strength can be secured.

Further, according to this embodiment, the size of the foundation chain knitting yarn 8 composing the wale W4 disposed at an outermost of the aforementioned four wales W1–W4 of the fastener element attaching portion T1 is formed smaller than those of the binding chain knitting yarns 6, 7. Further, the size of the second weft in-laid yarn 11 to be inserted such that it is inverted alternately to catch in a zigzag shape between two rows of wales W1 and W2 beside the tape main body T2 is larger than those of the other yarns forming the fastener tape T.

The first weft in-laid yarn 10 to be inserted in a zigzag shape successively over the wales W1–W3 employs a yarn having a high heat shrinkage characteristic. On the other hand, a yarn having a larger size than the chain knitting yarn of the tape main body is used in the chain knitting yarn of the element attaching portion. The weft in-laid yarn and warp in-laid yarn other than the aforementioned thick weft In-laid yarn are to be of the same size. Meanwhile, it is permissible to insert the first weft in-laid yarns having a high heat shrinkage characteristic such that they are inverted alternately to catch in the zigzag shape successively over the wales W1 and W2.

In this embodiment, a disposition of intersecting yarns, particularly a disposition of the intersecting yarns at a border portion between the fastener element attaching portion T1 and tape main portion T2 has an important meaning. In an indicated example, the first weft In-laid yarn 10 having a high heat shrinkage characteristic is located on an upper face of the thickest second weft in-laid yarn 11. Further, the thickest second weft in-laid yarn 11 is disposed at the nearest of the bottom face of the fastener tape T. When the slide fastener is heat-treated after knitting, the first weft inlaid yarn 10 shrinks so as to tighten three rows of wales W1–W3 toward the tape main portion T2 and as a result, the second weft in-laid yarn 11 is bent so as to be swollen to the rear face of the fastener tape T.

As a result, as shown in FIG. 2, the surface of the fastener element attaching portion T1 is located below the surface of the tape main portion T2 with a step. Consequently, the entire fastener element row ER knitted into the surface of the fastener element attaching portion T1 sinks below the surface of the tape, so that the height of the element portion E exposed above the surface of the tape becomes substantially half. Further, the density between the wales in the course direction of the fastener element attaching portion T1 is increased. Particularly, by disposing the connecting portion C of the element portion E for connecting the adjacent upper/lower leg portions L in the middle of two rows of the wales W1 and W2 beside the tape main body T2, the aforementioned step is further clarified.

With such a feature, when the slide fastener shown in the example is attached to, for example, thin, flexible clothes by sewing or the like and pressed with an iron, no pressing trace of the fastener elements is left on the clothes so that the clothes is always finished beautifully. Further, since the density between the wales in the course direction of the fastener element attaching portion T1 is increased, the binding of the element portion E on the attaching portion T1 is strengthened. As a result, the element portion E never moves so that a trouble such as slip-out of coupling is prevented.

By setting the size of the foundation chain knitting yarn 8 forming the wale W4 disposed at an outermost of the four wales W1–W4 of the fastener element attaching portion T1 smaller than those of the binding chain knitting yarns 6, 7 as described above, the outer side edge of the fastener element attaching portion T1 of a fastener stringer produced is thinner as compared to other portions. Thus, when the slide fastener is opened/closed by operating a slider S indicated by phantom line of FIG. 2, the aforementioned outer side edge does not become an obstacle in a narrow elements guide path of the slider S, so that the slider S can be operated smoothly.

The warp in-laid yarns 9 are knitted along the wales W2, W3 composed of the binding chain knitting yarns 6, 7 of the aforementioned four wales W1–W4 in the fastener element attaching portion T and the wale W4 of the foundation chain yarn 8 disposed at the outermost such that they are inverted alternately to catch in the zigzag shape between the chain knitting yarn stitches. With this feature, the configuration of each wale is stabilized, so that the fastener element row ER is bound to the fastener element attaching portion T1 in a further stabilized state. Meanwhile, it is permissible to add the aforementioned warp in-laid yarn 9 to the wale W1 composed of the attaching portion foundation chain knitting yarn 5 beside the tape main portion T2.

However, the size and quantity of each yarn for use as the binding knitting yarn or foundation structure are determined depending on the kind and purpose of the slide fastener and they are not specified in one form. Although FIG. 1 shows a state having a loose stitch, this is provided to achieve understanding of the knitted fabric structure, and actual stitch is tightened more closely.

What is claimed is:

1. A knitted-in slide fastener in which a continuous fastener element row is knitted into a fastener element attaching portion formed continuously along a side edge of a fastener tape main portion composed of warp knitted foundation structure at the same time when the fastener tape is knitted, wherein said fastener element attaching portion is structured of plural rows of wales comprising binding chain knitting yarns for tightening and binding a leg portion of each element portion, plural rows of wales comprising attaching portion foundation chain knitting yarns composing a foundation structure of said attaching portion and plural weft in-laid yarns inserted such that they are inverted alternately between said wales, said continuous fastener element row is disposed on an upper face of sinker loops of said binding chain knitting yarns, said attaching portion foundation chain knitting yarns and said weft in-laid yarns while the leg portion of each element portion is tightened and bound by needle loops of said binding chain knitting yarns from an upper face, said weft in-laid yarns caught such that they are inverted alternately between respective wales composed of said attaching portion foundation chain knitting yarns beside the fastener tape main portion and the binding chain knitting yarns beside the leg portion of said element portion are formed of a yarn having a larger size than other knitting yarns, said weft in-laid yarns disposed on the upper face of said weft in-laid yarn having a large size intersecting therewith and caught such that they are inverted alternately between wales composed of the attaching portion foundation chain knitting yarn beside said fastener tape main portion and any one of the binding chain knitting yarns are composed of yarns having heat shrinkage characteristic, and said weft in-laid yarn having a large size is disposed at a bottommost face of the fastener tape.

2. A knitted-in slide fastener according to claim 1, wherein a connecting portion for connecting the leg portions adjacent to each other of said element portion is disposed substantially in the center between the wales structured of said attaching portion foundation chain knitting yarn beside said fastener tape main portion and said binding chain knitting yarn beside the leg portion of said element portion.

3. A knitted-in slide fastener according to claim 1, wherein the foundation chain knitting yarn disposed at the outermost of said fastener element attaching portion is composed of a yarn having a smaller size than said binding chain knitting yarn.

4. A knitted-in slide fastener according to claim 1, wherein warp in-laid yarns are disposed below said fastener element row and caught such that they are inverted alternately between respective chain knitting yarn stitches along each of the wale formed of said binding chain knitting yarns and the wale of said attaching portion foundation chain knitting yarns disposed at the outermost of said fastener attaching portion.

* * * * *

UNITED STATES PATENT AND TRADEMARK OFFICE

CERTIFICATE OF CORRECTION

PATENT NO. : 6,148,643 B1
DATED : November 21, 2000
INVENTOR(S) : Yoshio Matsuda et al.

It is certified that error appears in the above-identified patent and that said Letters Patent is hereby corrected as shown below:

Title page,
Item [76], delete in its entirety and substitute therefore:

-- [75] Inventors: Yoshio Matsuda; Hidenobu Kato; Yoshida Ikeguchi, all of Toyama-ken, Japan

[73] Assignee: YKK Corporation, Tokyo, Japan --.

Signed and Sealed this

Second Day of April, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,148,643
DATED : November 21, 2000
INVENTOR(S) : Yoshio Matsuda et al.

It is certified that error appears in the above-identified patent and that said Letters Patent is hereby corrected as shown below:

Title page,
Item [75], Inventor, "Yoshida Ikeguchi" should read -- Yoshito Ikeguchi --.

Signed and Sealed this

Twenty-fourth Day of December, 2002

JAMES E. ROGAN
*Director of the United States Patent and Trademark Office*